US005601124A

United States Patent [19]

Weinheimer et al.

[11] Patent Number: 5,601,124

[45] Date of Patent: Feb. 11, 1997

[54] AUTOINFLATOR WITH APERTURED HOUSING

[75] Inventors: Jacek M. Weinheimer, Treasure Island; Lyman W. Fawcett, Jr., St. Petersburg, both of Fla.

[73] Assignee: Halkey-Roberts Corporation, St. Petersburg, Fla.

[21] Appl. No.: 385,040

[22] Filed: Feb. 7, 1995

[51] Int. Cl.[6] ..... B63C 9/24

[52] U.S. Cl. ..... 141/19; 141/313; 222/5; 222/54

[58] Field of Search ..... 141/19, 313, 329, 141/348, 384, 114; 222/5, 54; 441/92, 93, 95, 41; 128/202.14, 203.21, 205.21

[56] References Cited

U.S. PATENT DOCUMENTS

| | | | |
|---|---|---|---|
| 3,809,288 | 5/1974 | Mackal | 141/19 |
| 3,934,292 | 1/1976 | Mulderrig | 441/95 |
| 4,260,075 | 4/1981 | Mackal | 222/5 |
| 4,267,944 | 5/1981 | Mackal | 222/5 |

*Primary Examiner*—Henry J. Recla
*Assistant Examiner*—Steven O. Douglas
*Attorney, Agent, or Firm*—Trexler, Bushnell, Giangiorgi & Blackstone, Ltd.

[57] ABSTRACT

An inflator for the inflation of inflatable articles such as life vests and the like, such inflator being operated automatically upon being subjected to water as upon the ditching or parachuting of an aviator wearing a life vest provided with such inflator. In the preferred embodiment of the inflator disclosed, the automatically operating portion of it is embodied as an attachment to a known manually operated inflator, the resulting inflator being capable of operation both manually and automatically. The automatically operating portion of the inflator incorporates a releasable blocking device which holds an actuator pin operated by a coil compression spring in cocked condition until the releasable blocking device releases the actuator pin, which thereafter thrusts a piercing pin against and through the sealing diaphragm of a gas-containing capsule. The releasable blocking device is provided with a water destructible element which retains the releasable blocking device in actuator pin cocking position until the water destructible element is subjected to water and sufficiently weakened so that the releasable blocking device releases the actuator pin. The actuator body having specially designed apertures so that inadvertent water splashes and moisture will not prematurely activate the inflator. The apertures promote an activation of the inflator only during emergency situations in which the inflator is submerged under water.

15 Claims, 6 Drawing Sheets

10
22
12
32
34
36
18
30
28
24
38
62
26
40
50
48
42
44
52
56
46
74
14
54
58
60
86
98
82
80
16
99
100

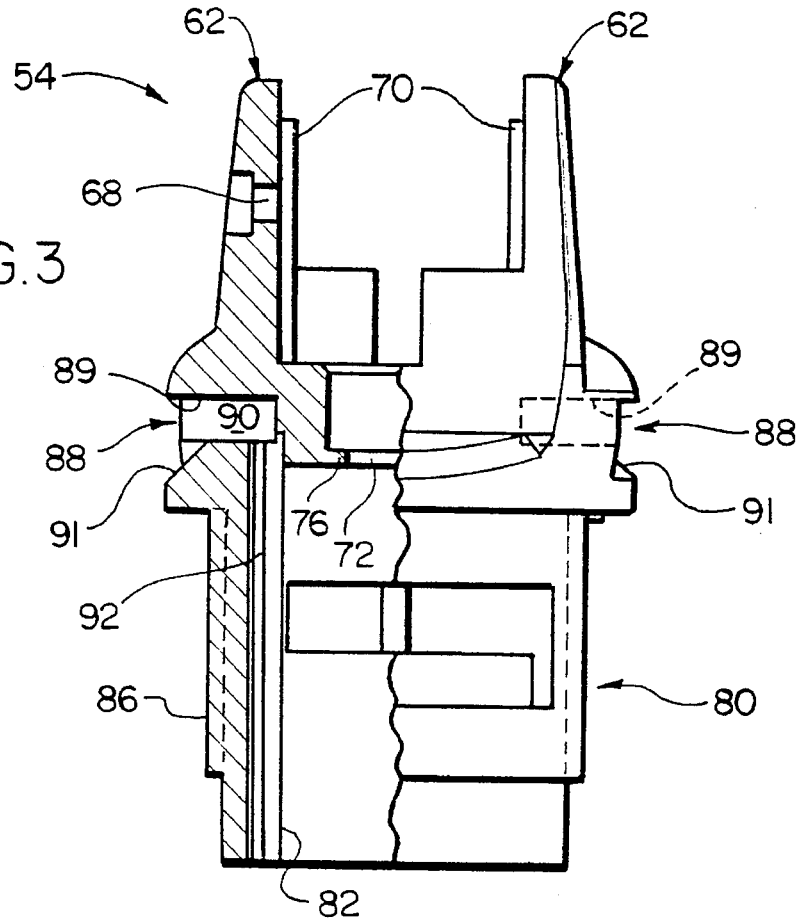
FIG.3
FIG.4
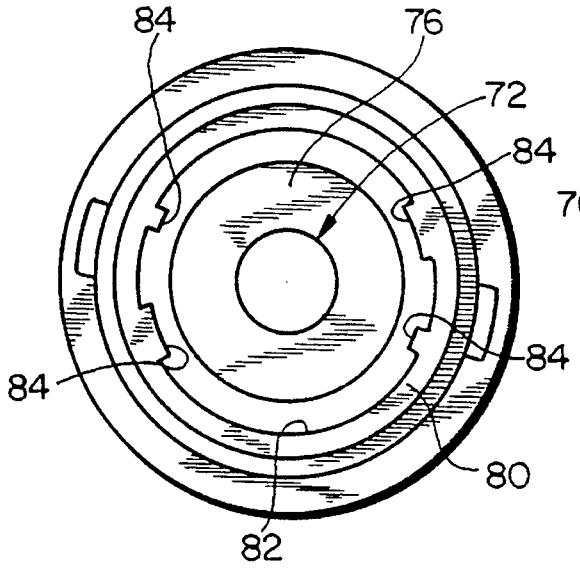
FIG.5
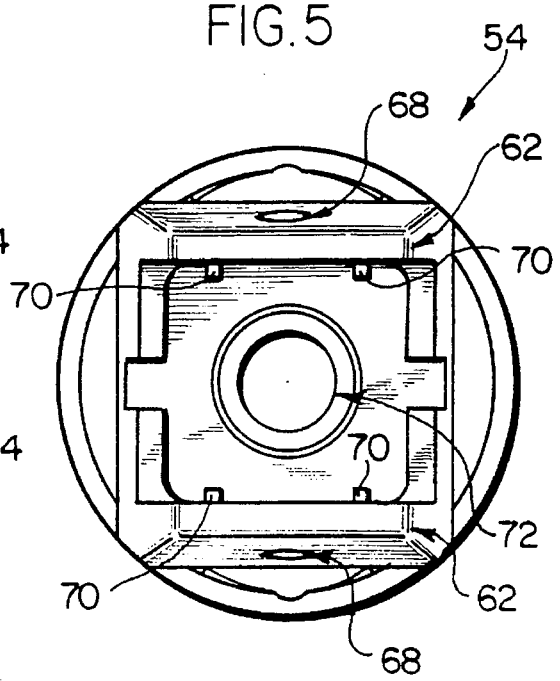

AUTOINFLATOR WITH APERTURED HOUSING

BACKGROUND OF THE INVENTION

1. Field of the Invention

This invention relates to an automatic inflator for inflatable articles such as life rafts, life vests, and the like. In the disclosed preferred embodiment thereof, the inflator is capable of operation both manually and automatically, the inflator in the latter mode of operation being operated automatically upon its subjection to water.

2. Description of the Background Art

Presently, there exists many types of inflators designed to inflate inflatable articles such as personal floatation devices (life vests, rings and horseshoes), life rafts, buoys and emergency signalling equipment. Inflators typically comprise a body for receiving the neck of a cartridge of compressed gas such as carbon dioxide. A reciprocating piercing pin is disposed within the body of the inflator for piercing the frangible seal of the cartridge to permit compressed gas therein to flow into a manifold assembly of the inflator and then into the article to be inflated. Typically, a manually movable firing lever is operatively connected to the piercing pin such that the piercing pin pierces the frangible seal of the cartridge upon jerking of a ball lanyard. U.S. Pat. No. 3,809,288, the disclosure of which is hereby incorporated by reference herein, illustrates one particular embodiment of a manual inflator.

While manual inflators work suitably well, it was quickly learned that in an emergency situation, the person needing the assistance of the inflatable device, such as a downed aviator, injured person, or a man overboard, would fail or be unable to manually activate the inflator. Accordingly, it was realized that a means should be provided for automatically activating the inflator in such an emergency situation.

In response to this realized inadequacy of the prior art manual inflators, water activated automatic inflators were developed which, when exposed to a fluid such as water, automatically activated the piercing pin of the inflator when immersed in water thereby causing inflation of the inflatable device. Typical water activated automatic inflators comprise a water activated trigger assembly including a water destructible or dissolvable element which retains a spring-loaded actuator pin in a cocked position in alignment with a piercing pin. Upon exposure to water, causing the element to destruct or dissolve, the spring loaded actuator pin is released to forcibly move from the cocked position to an actuated position to strike the piercing pin, either directly or indirectly by means of an intermediate transfer pin. Upon striking the piercing pin, the pin fractures the seal of the cartridge thereby allowing the gas contained therein to flow into the inflatable device to inflate the same. Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, and 5,076,468, the disclosures of which are hereby incorporated by reference herein.

While the above referenced automatic inflators operate quite well in inflating inflatable devices in the event of an emergency situation, one major disadvantage to these automatic inflators is their tendency to be prematurely activated in non-emergency situations by errant moisture and water splashes coming into contact with the water destructible or dissolvable element contained in the actuator body. This unwanted water contact was due to the design of the apertures on the actuator bodies utilized in the prior art. The apertures are to facilitate the entering of water into the actuator body during emergency situations, like when an aviator is downed in the ocean, so that the water will contact the destructible or dissolvable element and thereby automatically activate the inflator.

The problem of prematurely and unintentionally activated automatic inflators is so acute that it is not uncommon to be readily replacing the water destructible elements and resetting the automatic inflators on a regular basis when the inflators are constantly stored around water. It is noted that each of the prior art water activated automatic inflators disclosed in the above referenced patents teach a structure which may easily be disassembled to facilitate the replacement of the water destructible element and gas-containing capsule so that the inflator may be reused.

Therefore, it is an object of this invention to provide an improvement which overcomes the aforementioned inadequacies of the prior art devices and provides an improvement which is a significant contribution to the advancement of the inflation art.

Another object of this invention is to provide an automatic inflator that has an actuator body having specially designed apertures so as to preclude errant moisture and water splashes from prematurely activating the automatic inflator in non-emergency situations.

Another object of this invention is to provide an automatic inflator having an actuator body with apertures designed such that the bottom internal side of the apertures are sloped from inward to outward thereby preventing water splashes from entering the actuator body and contacting the water destructible element therein and activating the inflator.

Another object of this invention is to provide an automatic inflator that has an actuator body having an internal means for preventing the water destructible element and actuator pin from twisting relative to each other while resetting and assembling the inflator thereby preserving the pre-release structure of the water destructible element which was being deformed upon initial engagement with the actuator pin upon assembly.

Another object of this invention is to provide an automatic inflator that will only automatically inflate when it is submerged in water.

Another object of this invention is to provide an automatic inflator having an intermediate pin that more securely engages the piercing pin upon the activation of the inflator.

Another object of this invention is to provide an automatic inflator having an intermediate pin that requires less tooling and thereby is more economical to manufacture.

Another object of this invention is to provide an automatic inflator having an actuator pin that is made of a single one piece injection molded structure thereby lessening the cost of manufacturing the automatic inflator.

Another object of this invention is to provide an automatic inflator having a single one piece cylindrical cap that internally movably secures the actuator pin thereby reducing the number of required parts to assemble the inflator.

Another object of this invention is to provide an automatic inflator for inflating an inflatable article with gas from a gas-containing capsule, comprising in combination: an inflator body including a bore; a means at an upper end of the bore for receiving the gas-containing capsule; a piercing pin assembly which is reciprocatably positioned within the bore;

an actuator assembly positioned at a lower end of the bore for actuating the piercing pin assembly to allow gas from the gas-containing capsule to flow into the bore; means for fluidly connecting the bore to the inflatable article; and the actuator assembly comprising an actuator body having apertures positioned thereon, the apertures being in fluid communication with air passages facilitating access to the actuator assembly, the apertures further having bottom internal surfaces that slope downward, whereby when the inflator is in proper vertical position with the gas-containing capsule facing upwards the bottom internal surfaces of the apertures promote the flow of water splashes away from the air passages so as to allow the entering of water therein when submerged in water, and when not submerged in water, concurrently thereby preventing the entering of inadvertent water therein.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention comprises an automatic inflator that is either manually or water activated. More particularly, the inflator of the invention comprises a cylindrical cap, an actuator body, and an inflator body. The cylindrical cap internally movably containing an actuator pin that is forcibly biased by a compression spring also contained therein. The actuator pin being a single one-piece injection molded unit. The cylindrical cap being secured to the actuator body and thereby engaging the actuator pin with a water destructible element while compressing the compression spring.

The actuator body internally contains an intermediate pin which is forcibly moved forward towards the piercing pin by the actuator pin upon being released by the water destructible element when the inflator is submerged in water. The intermediate pin is selectively adapted to engage the rear end portion of the piercing pin in a more secure fashion so as to better transfer the force of the compression spring to the piercing pin and thereby cause the piercing of the gas-containing capsule.

In addition, the actuator body contains the water destructible element as well as apertures which allow water to enter therein and contact the water destructible element when the inflator is submerged in water.

The inflator body contains the piercing pin, the manual operating means, and a means for securing a gas-containing capsule such that the capsule is pierced by the piercing pin when the inflator is activated.

An important feature of the present invention is that the apertures contained in the actuator body are designed in such a manner as to preclude errant moisture and water splashes from entering the actuator body and causing a unintentional premature activation of the inflator.

Another important feature of the present invention is that the actuator pin is a single one-piece injection molded unit that simplifies the assembly of the inflator and decreases the cost to manufacture the inflator.

Another important feature of the present invention is that the actuator body has internal grooves which engage both the water destructible element and the actuator pin thereby preventing them from twisting relative to each other when resetting and assembling the inflator.

Therefore, it can be readily appreciated that the present invention precludes premature unintentional activations of the automatic inflator caused by errant moisture and water splashes which frequently occur in the industry.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which:

FIG. 3 is a cross-sectional view of FIG. 2 taken along lines 3—3 illustrating the aperture structure and the aperture's bottom internal side design;

FIG. 4 is a bottom view of the actuator body showing the internal guide grooves on the skirt and the central bore therein;

FIG. 5 is a top view of the actuator body showing the central bore and the internal flange that engages the rearward end portion of the intermediate pin;

Similar reference numerals refer to similar parts throughout the several figures.

DESCRIPTION OF THE PREFERRED EMBODIMENTS

Figure 1:
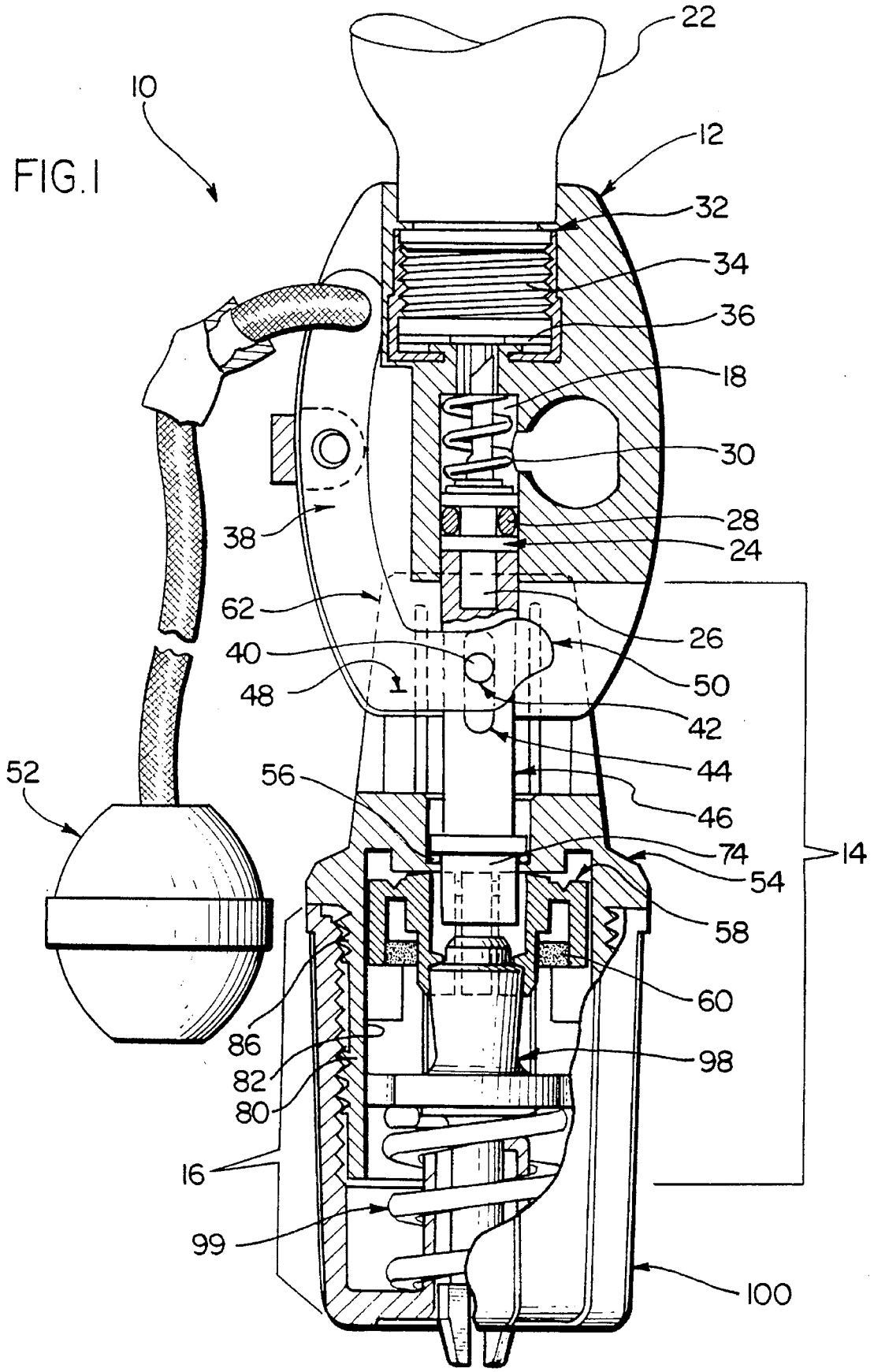
FIG. 1 is a longitudinal cross-sectional view of the automatic inflator assembly showing the various internal parts and their relative position to one another.

As shown in FIG. 1, the automatic inflator 10 of the invention comprises an inflator body 12, an actuator body assembly 14, and a cylindrical cap assembly 16. The inflator body 12 has a general oval shape. Most preferably, the material constituting the inflator body 12 comprises a material such as polyurethane, polyester, or polyether, each of which are known to be commonly used in the industry.

The inflator body 12 has a longitudinal central bore, generally indicated by numeral 18, having an upper end and a lower end and which is sized to receive a piercing pin assembly 20 reciprocatably positioned therein so that a gas-containing capsule 22 is pierced when the piercing pin assembly 20 is forcibly moved towards the capsule 22. The piercing pin assembly 20 comprises a piercing pin 24 having a rear end portion 26, a sealing gasket 28, and a small compression spring 30. A conventional metal insert 32, having interior threads 34 and gasket 36, is molded in situ within the upper portion of the inflator body 12. As seen in phantom in FIG. 1, the gas-containing capsule 22 may be threaded into the metal insert 32. The gasket 36 assures that the gas-containing capsule 22 is sealed within the metal insert 32.

The manual operating means is located on the inflator body 12. As seen in FIG. 1, the manual operating means includes a lever 38, of generally an L-shape, pivotally mounted to the lower portion of the inflator body 12 by a pivot pin 40 which passes through the inflator body 12, a hole 42 located in the lower portion of the lever 38, and a second slot portion 44 of an intermediate pin 46. The lower end portion 48 of the lever 38 has a cam extension 50 which forcibly acts indirectly on the piercing pin assembly 20 when the lever 38 is pulled and thereby causes the gas-containing capsule 22 to be pierced. The second slot portion 44 permitting the longitudinal movement of the intermediate pin 46 relative to the pivot pin 40. A lanyard handle 52 is connected to the lever 38.

The pivot pin 40 fixedly secures the actuator body assembly 14 to the inflator body 12. The actuator body assembly 14 of the invention is generally comprised of an actuator body 54, the intermediate pin 46, a conventional o-ring 56, and a releasable blocking means 58 having a water destructible element 60.

Figure 2:
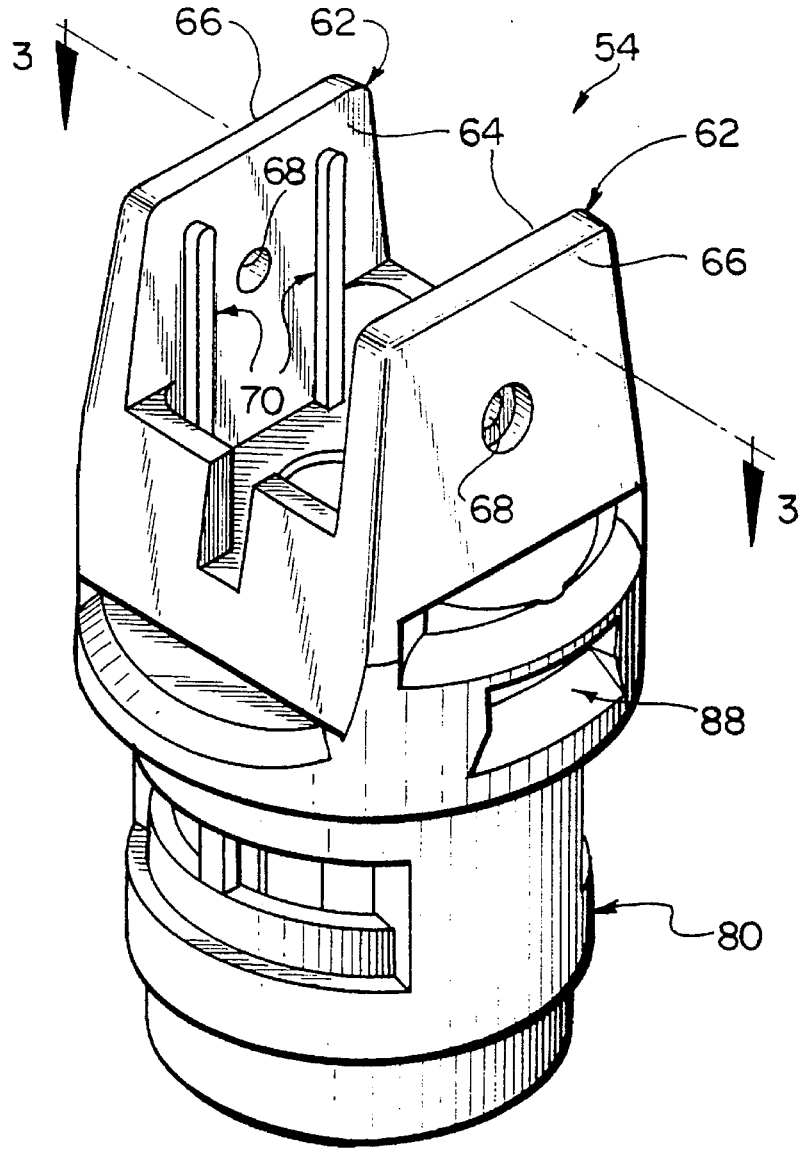
FIG. 2 is an isometric view of the actuator body illustrating the apertures, aligned holes in the parallel arms, and their relative positioning about the actuator body.

In referring to FIG. 2, the actuator body 54 is of a general circular cylindrical shape having a pair of extending parallel arms 62 which are mirror images of each other and which are spaced apart a distance which only slightly exceeds the thickness of the inflator body 12. The pair of extending parallel arms 62 further include internal surfaces 64, external surfaces 66, and aligned opposing holes 68. The aligned opposing holes 68 receive the pivot pin 40 which facilitates the securing of the actuator body 54 to the inflator body 12. As seen in FIGS. 2, 3, and 5, a pair of stabilizing ridges 70 extend inward from the internal surfaces 64 of each of the extending parallel arms 62 so as to engage the inflator body 12 and prevent any possible pivotal movement by the actuator body 54 relative to the inflator body 12 once fixedly secured to each other.

In referring to FIGS. 4 and 5, it is shown that the actuator body 54 further includes a central bore, generally indicated by numeral 72, for receiving the rearward end portion 74 of the intermediate pin 46. A body flange 76 is located about the central bore 72 that engages a flange 78 on the intermediate pin 46. In FIG. 3, a thin-walled skirt 80 is shown extending longitudinally downward having an internal surface 82 with a plurality of guide grooves 84 extending inward therefrom and external threads 86. The plurality of guide grooves 84 receives the releasable blocking means 58 and thereby prevents the blocking means 58 from turning while in position.

Most importantly, as shown in FIGS. 2 and 3, the actuator body 54 includes apertures 88 positioned upward from the thin-walled skirt 80 and below each of the parallel arms 62. The apertures 88 are generally rectangular in shape and have a top internal surface 89, opposing side internal surfaces 90, and a bottom internal surface 91. The apertures 88 have a specially designed bottom internal surface 91 wherein the bottom internal surface 91 slopes downward causing an increasing dimension of the apertures 88 from inward to outward. Thus, when the automatic inflator 10 is in its proper vertical position with the gas-containing capsule 22 facing upwards, the downward sloping aspect of the bottom internal surfaces 91 of the apertures 88 acts to promote the flow of inadvertent water splashes down, out and away from the air passages 92 located in the upper back of the apertures 88 and to thereby preclude the inadvertent water splashes from prematurely activating the automatic inflator 10. Additionally, in the back of the apertures 88, air passages 92 are located which provide access to the internal surface 82 of the thin-walled skirt 80.

Figure 6:
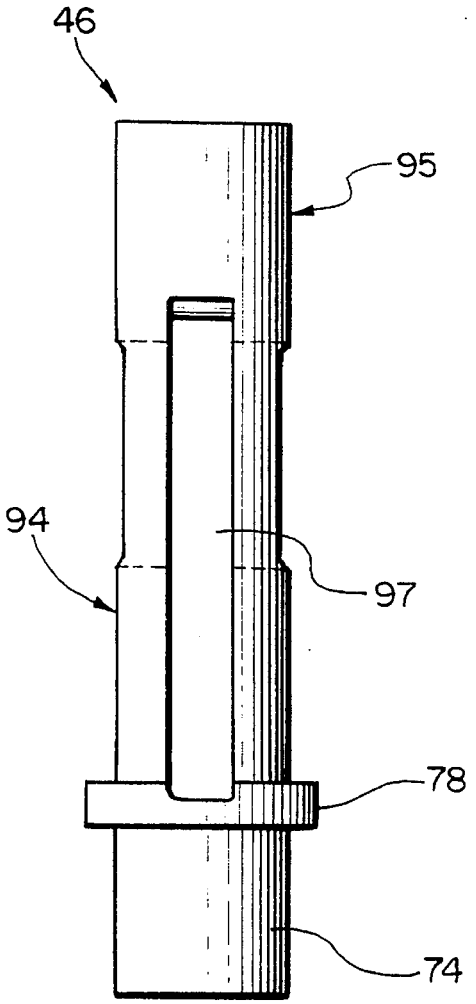
FIG. 6 is a longitudinal plan view of the intermediate pin showing the relative positioning of the first slot portion, the rearward end portion, the flange, and the forward end portion.
Figure 6A:
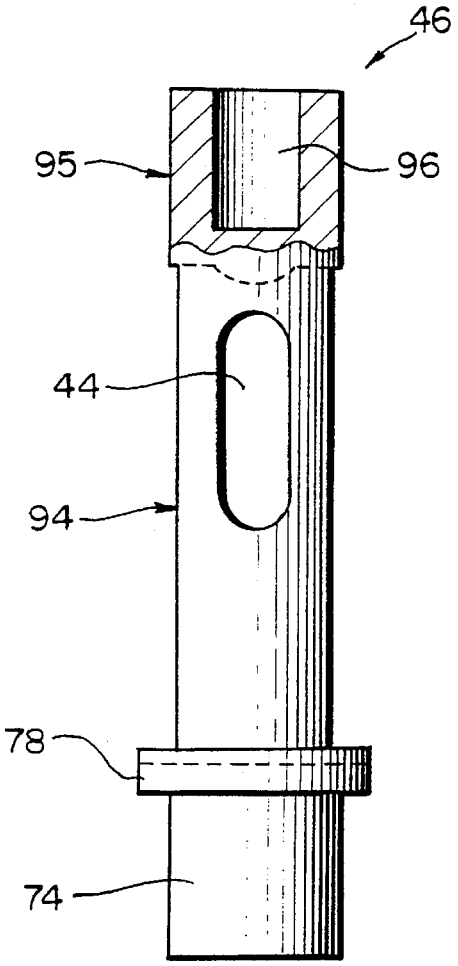
FIG. 6*a* is a longitudinal cross-sectional view of the intermediate pin showing the forward end portion with its partial central bore that receives the rear end portion of the piercing pin, and the relative positioning of the second slot portion.
Figure 6B:
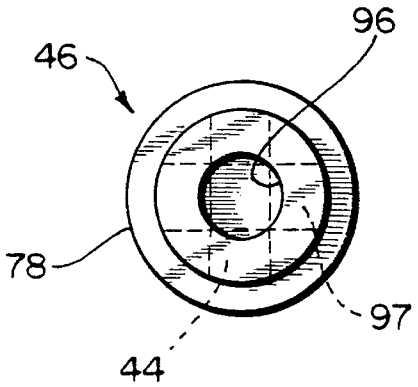
FIG. 6*b* is a forward view of the intermediate pin illustrating how the partial central bore, the first and second slot portions, and the flange relate to each other.

In now referring to FIGS. 6, 6*a*, and b, the intermediate pin 46 is shown. The intermediate pin 46 is comprised of the rearward end portion 74, a forward circular cylindrical portion 94, and a flange 78 therebetween. The intermediate pin 46 is received by the lower portion of the inflator body 12 and the central bore 72 of the actuator body 54. A conventional O-ring 56 is placed between the flange 78 of the intermediate pin 46 and the body flange 76 of the actuator body 54 thereby forming a seal.

The circular cylindrical portion 94 of the intermediate pin 46 further includes a forward end 95 having a partial central bore 96 therein, a first elongated slot portion 97 extending from the flange 78 to the forward end 95, and a second slot portion 44 perpendicular to the first elongated slot portion 97. The second slot portion 44 is positioned behind and abutting the forward end 95 of the intermediate pin 46 and the intermediate pin 46 is aligned with the piercing pin 24 whereby the forward end 95 confronts and is selectively adapted to engage the rear end portion 26 of the piercing pin 24.

Figure 7:
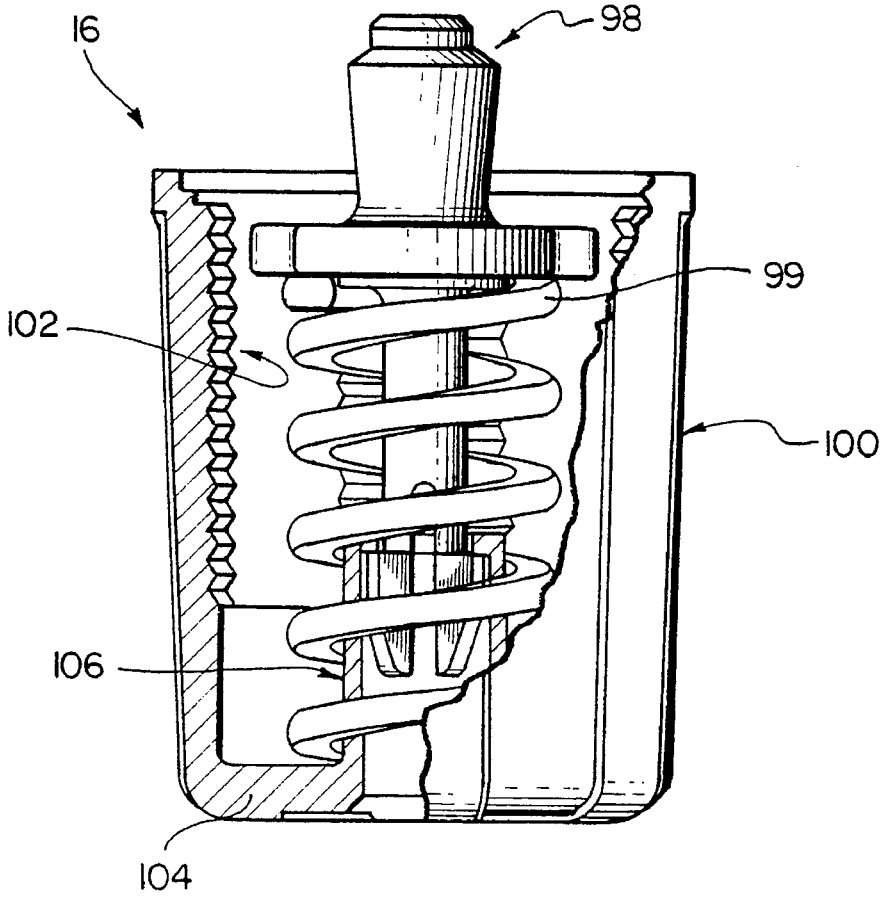
FIG. 7 is a cross-sectional view of the cylindrical cap assembly showing the relative positioning of the actuator pin, the large compression spring, and the cylindrical cap.
Figure 7A:
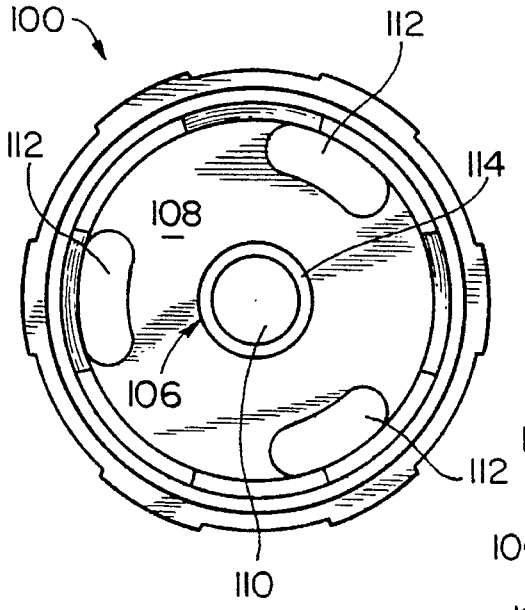
FIG. 7*a* is a top view looking down into the cylindrical cap illustrating the relative positioning of the central hole, the satellite holes and the external fluting.
Figure 7B:
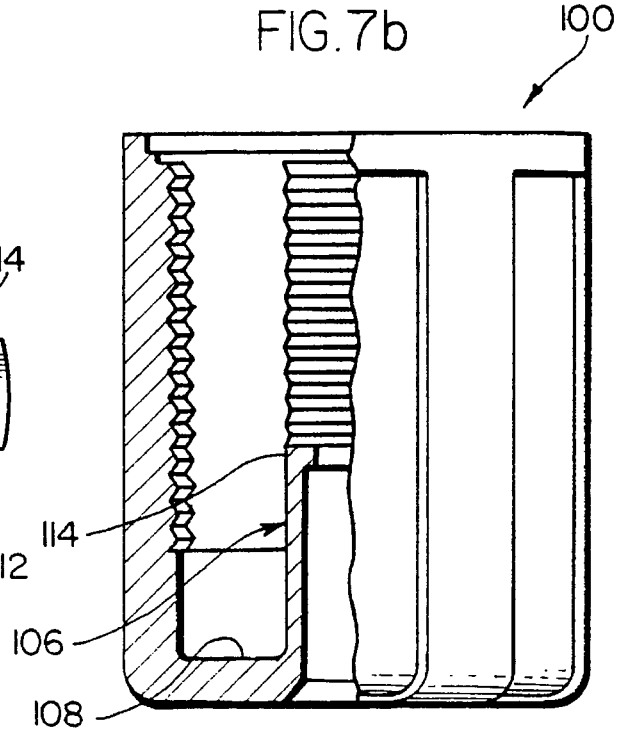
FIG. 7*b* is a cross-sectional view showing the internal cylindrical boss and threads of the cylindrical cap.
Figure 7C:
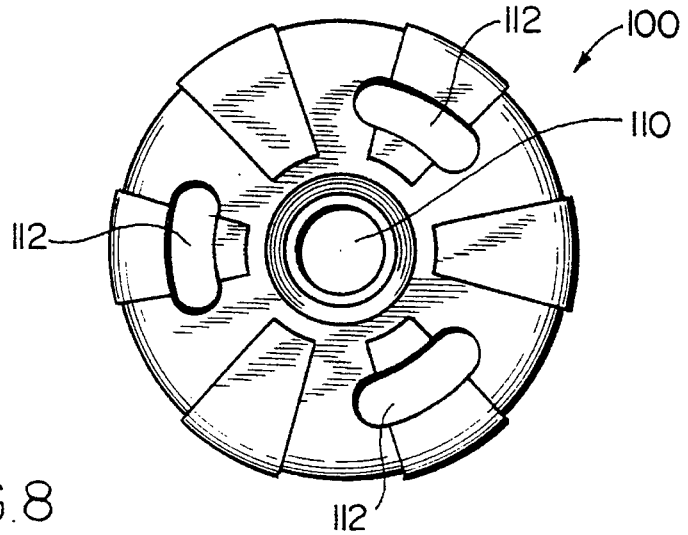
FIG. 7*c* is a bottom view showing the fluting, the central hole, and the internal cylindrical boss end lip of the cylindrical cap.

Now in referring to FIG. 7, the cylindrical cap assembly 16 is shown. The cap assembly 16 comprises an actuator pin 98, a large compression spring 99, and a cylindrical cap 100 having internal screw threads 102, a closed end 104, and an internal cylindrical boss 106. In FIGS. 7*a*, 7*b*, and 7*c*, the cylindrical cap 100 is shown in greater detail to further include an internal end surface 108, a concentrically located hole 110, and evenly spaced satellite holes 112 situated about the concentrically located hole 110. The internal cylindrical boss 106 is concentrically extending from said internal end surface 108 about the concentrically located hole 110. The internal cylindrical boss 106 further comprises a boss end lip 114 protruding radially inward.

Figure 8:
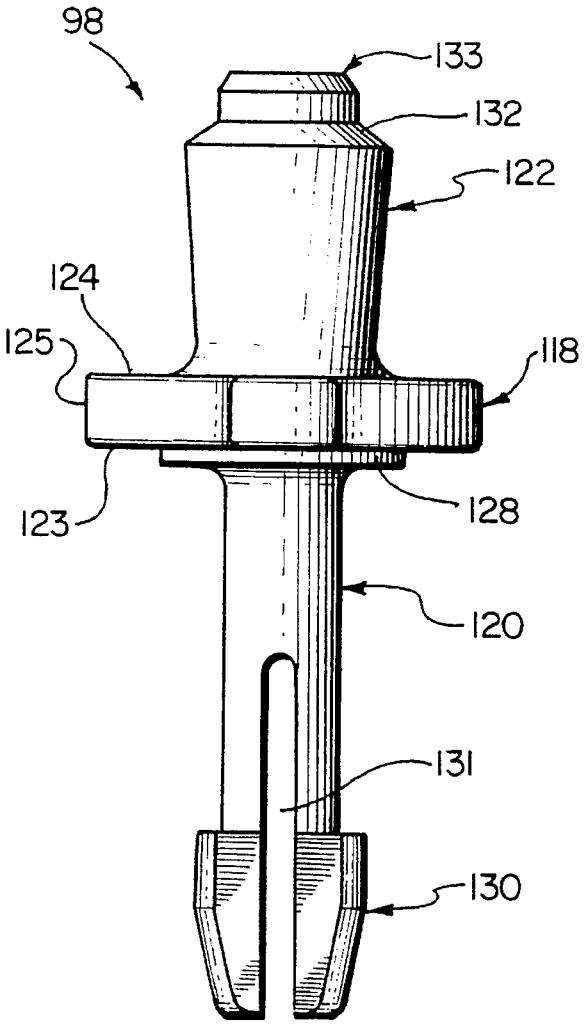
FIG. 8 is a longitudinal view of the actuator pin showing the circular flat head portion, the actuator head, and the frustro conical end portion relative to each other.
Figure 8A:
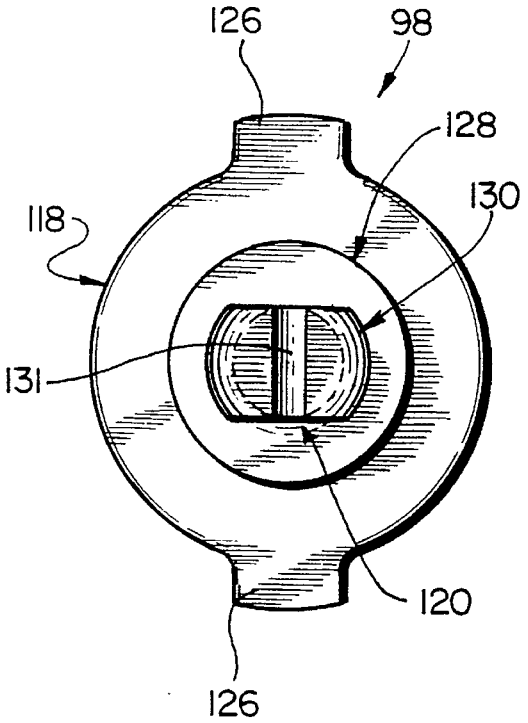
FIG. 8*a* is a bottom view of the actuator pin showing the pair of radially protruding opposed edge tabs on the circular flat head portion.

Now, in referring to FIGS. 8 and 8*a*, the actuator pin 98 can be seen in greater detail. The actuator pin 98 extends longitudinally and centrally having a circular flat head portion 118, a circular cylindrical stem portion 120, and an actuator head 122. The actuator pin 98 is a single injection molded unit that is made out of a material such as polycarbonate or polyurethane (polyester- or polyether-based), each of which are readily known in the industry and used in injection mold processes. The circular flat head portion 118 further includes a back side 123, a front side 124, and a radial edge 125 therebetween, a pair of radially protruding opposed edge tabs 126, and a spring seat step portion 128 extending from the back side 123.

As seen in FIG. 8, the circular cylindrical stem portion 120 extends centrally from the spring seat step portion 128. The circular cylindrical stem portion 120 includes a frustro conical end portion 130, and an elongated slot 131 extending through said frustro conical end portion 130 and into a portion of said stem portion 120. This elongated slot 131 facilitates the flexing of the frustro conical end portion 130 when engaging the internal cylindrical boss 106 and the internal boss end lip 114 in the cylindrical cap 100.

The actuator head 122 longitudinally centrally extends from the front side 124 of the circular flat head portion 118. The actuator head 122 further includes an engaging end 132 having a guide nipple 133 extending longitudinally and centrally therefrom. The actuator head 122 has an increasing diameter from the front side 124 of the circular flat head portion 118 to the engaging end 132.

Upon assembly of the automatic inflator 10, the engaging end 132 and guide nipple 133 of the actuator pin 98 are received by the releasable blocking means 58 within the actuator body 54, as seen in FIG. 1. The pair of radially protruding opposed edge tabs 126 of the circular flat head portion 118 thereby engage the plurality of guide grooves 84 in the thin-walled skirt 80 to prevent the actuator pin 98 and releasable blocking means 58 from twisting relative to each other when assembling the automatic inflator 10.

In referring back to FIG. 7, the highly conventional large compression spring 99 having an internal diameter significantly larger than the external diameter of the internal cylindrical boss 106 is concentrically positioned around the same. The large compression spring 99 is positioned between the closed end 104 of the cylindrical cap 100 and the back side 123 of the flat head portion 118 of the actuator pin 98. The large compression spring 99 is oriented on the flat head portion 118 by engaging the spring seat step portion 128. The frustro conical end portion 130 of the actuator pin 98 is centrally inserted through the large compression spring 99 along its longitudinal axis and forcibly received by the internal cylindrical boss 106. The frustro conical end portion 130 is thereby held in position by engaging said internal boss end lip 114.

In assembling the automatic inflator 10 as is illustrated in FIG. 1, the cylindrical cap 100 is threadedly engaged with the thin-walled skirt 80 on the cylindrical actuator body 54. The actuator pin 98, guided by the guide grooves 84 engaging the radially protruding opposed edge tabs 126 of the circular flat head portion 118, is received by the releasable blocking means 58 positioned in the actuator body 54.

Figure 1A:
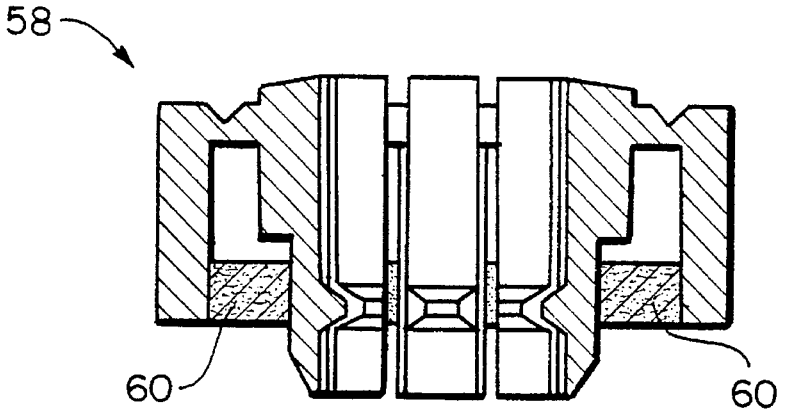
FIG. 1*a* is an enlarged cross-sectional view of the releasable blocking means showing the relative position of the water destructable element within.

The releasable blocking means 58 retains the actuator pin 98 at a constant position while the actuator body assembly 14 threadingly engages the cylindrical cap assembly 16 so as to cause the large compression spring 99 to compress and thereby buildup a stored energy. Whereupon when the automatic inflator 10 is subjected to water, the water destructible element 60 in the releasable blocking means 58 (refer to FIG. 1*a*) deteriorates so as to cause the releasable blocking means 58 to release the actuator pin 98. The actuator pin 98 is then forcibly thrust toward the intermediate pin 46 due to the large compression spring 99 expending its stored energy. The intermediate pin 46 then, in turn, is forcibly thrust toward the piercing pin 24 which thereby pierces the gas-containing capsule 22.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. A gas inflator for an inflatable article, the inflator being selectively operable either manually or automatically upon its subjection to water, comprising in combination:

an inflator body, said inflator body having a means for attaching a gas-containing capsule to said body, a piercing pin having a rear end portion, whereby said piercing pin is movable in said inflator body toward said capsule, a manual operating means acting on the said rear end portion of said piercing pin to thrust said piercing pin towards said capsule;

an intermediate pin, said intermediate pin having a rearward end portion, a forward circular cylindrical portion, and a flange therebetween, whereby said forward circular cylindrical portion has a forward end, said intermediate pin being aligned with said piercing pin whereby said forward end confronts and is selectively adapted to engage said rear end portion of said piercing pin;

a circular cylindrical actuator body, said actuator body having a means for securing said actuator body to said inflator body, a central bore for receiving said rearward end portion of said intermediate pin, a body flange that engages said flange of said intermediate pin, a thin-walled skirt, said thin-walled skirt having external threads, an internal surface, and a plurality of guide grooves on said internal surface, and opposing apertures positioned upward from said skirt, said opposing apertures having a bottom internal surface that slopes downward so to thereby promote the flow of water splashes away from air passages located in the back of said apertures, said apertures allowing air and water to pass through to the internal surface of said skirt when completely immersing said inflator under water, while at the same time preventing mere water splashes from passing through to the internal surface of said skirt and prematurely activating the automatic inflator;

a longitudinally centrally extending actuator pin, said actuator pin having a circular flat head portion, wherein said flat head portion includes a back side, a front side, and a pair of radially protruding opposed edge tabs, a circular cylindrical stem portion longitudinally centrally extending from said back side of said circular flat head portion, an actuator head longitudinally centrally protruding from said front side of said circular flat head portion, said actuator head having an engaging end, and a guide nipple, said engaging end and guide nipple being received by said releasable blocking means, said pair of radially protruding opposed edge tabs thereby engaging said plurality of guide grooves on said internal surface of said thin-walled skirt to prevent the actuator pin and releasable blocking means from twisting relative to each other when assembling said automatic inflator;

a cylindrical cap, said cap having internal screw threads, a closed end having an internal end surface, an internal cylindrical boss, a boss end lip protruding radially inward, and a boss end lip groove to allow flexibility in said boss end lip, whereby said internal cylindrical boss is concentrically extending from said internal end surface about the longitudinal axis of said cap; and a coil compression spring, whereby said coil compression spring has an internal diameter significantly larger than the external diameter of said cylindrical boss so as to facilitate the concentrical positioning of said compression spring around said cylindrical boss in said cap, said compression spring being positioned between said closed end of said cap and said back side of said flat head portion of said actuator pin, said actuator pin being secured to said end surface of said cap, said cap being threadedly engaged with said thin-walled skirt on said cylindrical actuator body thereby compressing said compression spring between said internal end surface of said cap and said flat head portion of said actuator pin, whereby said actuator pin is forcibly thrust toward said intermediate pin by said compression spring when said releasable blocking means is subjected to water and releases said actuator head, said intermediate pin thereby being thrust toward said piercing pin and forcing said piercing pin to pierce said capsule.

2. A gas inflator as recited in claim 1, wherein said circular cylindrical portion of said intermediate pin further includes a forward end having a partial central bore therein, a first elongated slot portion extending from said flange to said forward end, and a second slotted portion perpendicular to said first elongated slot portion, whereby said second slot portion is positioned behind and abutting said forward end.

3. A gas inflator as recited in claim 2, wherein said manual operating means comprises a rotatable cam directly engaging the said forward end portion of said intermediate pin through the first elongated slot portion, and a pivot pin mounting the cam on the inflator body, said pivot pin passing through said second slotted portion, said second slotted portion permitting the longitudinal movement of the intermediate pin relative to the pivot pin.

4. A gas inflator as recited in claim 3, wherein said means for securing said actuator body to said inflator body comprises a pair of extending parallel arms which are mirror images of each other and which are spaced apart a distance which only slightly exceeds the inflator body thickness.

5. A gas inflator as recited in claim 4, wherein said pair of extending parallel arms further includes internal surfaces, external surfaces, and aligned opposing holes, whereby said aligned opposing holes receive said pivot pin.

6. A gas inflator as recited in claim 5, wherein said circular flat head portion of said actuator pin further includes a spring seat step portion extending from said back side of said circular flat head portion, whereby said spring seat step portion facilitates the orientation of said compression spring on said back side of said circular flat head portion.

7. A gas inflator as recited in claim 6, wherein said stem portion of said actuator pin further includes a frustro conical end portion, and an elongated slot extending through said frustro conical end portion and into said stem portion, whereby said frustro conical end portion is inserted through said compression spring and forcibly received by said internal boss end lip of said cylindrical boss, said frustro conical end portion being thereby held in position by engaging said internal boss end lip.

8. A gas inflator as recited in claim 7, wherein said actuator head has an increasing diameter from said front side of said circular flat head portion to said engaging end.

9. A gas inflator as recited in claim 8, wherein said closed end further includes a concentrically located hole, and evenly spaced satellite holes situated about said concentrically located hole.

10. A gas inflator for inflating an inflatable article with gas from a gas-containing capsule, the inflator being selectively operable either manually or automatically upon its subjection to water, comprising in combination:

an inflator body including a bore; a means at an upper end of the bore for receiving the gas-containing capsule; a piercing pin assembly which is reciprocatably positioned within the bore; an actuator assembly positioned at a lower end of the bore for actuating the piercing pin assembly to allow gas from the gas-containing capsule to flow into the bore; means for fluidly connecting the bore to the inflatable article; and the actuator assembly comprising an actuator body having apertures positioned thereon, said apertures being in fluid communication with air passages facilitating access to said actuator assembly, said apertures further having bottom internal surfaces that slope downward, whereby when said inflator is in proper vertical position with the gas-containing capsule facing upwards said bottom internal surfaces of said apertures promote the flow of water splashes away from said air passages so as to allow the entering of water therein when submerged in water and, when not submerged in water, concurrently thereby preventing the entering of inadvertent water splashes therein.

11. A gas inflator as recited in claim 10, wherein said actuator assembly further comprises an intermediate pin having a first and second slot portion and a cylindrical cap assembly having an actuator pin, a cap and a large compression spring whereby said large compression spring forcibly thrusts said actuator pin toward said intermediate pin which therein forcibly thrusts said piercing pin assembly toward said gas-containing capsule.

12. A gas inflator as recited in claim 11, wherein said actuator pin is a single one-piece injection molded unit.

13. A gas inflator as recited in claim 11, wherein said intermediate pin further comprises a forward end portion being selectively adapted for engaging said piercing pin assembly.

14. A gas inflator as recited in claim 13, wherein said piercing pin assembly further comprises a piercing pin having a rear end portion, a conventional O-ring, and a small compression spring whereby said rear end portion of said piercing pin is received by said forward end portion of said intermediate pin.

15. A gas inflator as recited in claim 10, wherein said means at said upper end of the bore for receiving the gas-containing capsule further comprises a metal insert having interior threads and a gasket whereby said insert is molded in situ within the upper portion of the inflator body.

* * * * *